United States Patent [19]

Mitchell

[11] Patent Number: 4,967,517

[45] Date of Patent: Nov. 6, 1990

[54] POLISHING METHOD AND APPARATUS

[76] Inventor: Harry L. Mitchell, 24 Oakland Apt. #8, Aurora, Colo. 80012

[21] Appl. No.: 406,023

[22] Filed: Sep. 11, 1989

[51] Int. Cl.[5] ..... B24B 29/02

[52] U.S. Cl. ..... 51/171; 51/358; 51/391; 51/211 R; 51/181 R; 15/104.92; 15/268; 76/81

[58] Field of Search ..... 51/358, 391–393, 51/265, 171, 211 R, 211 H, 229, 407, 181 R; 76/81, 81.7; 15/104.92, 104.93, 268; 79/7, 18

[56] References Cited

U.S. PATENT DOCUMENTS

| | | | |
|---|---|---|---|
| 636,111 | 10/1899 | Buchanan | 51/171 |
| 681,771 | 9/1901 | Wright | 51/171 |
| 1,710,308 | 4/1929 | Grifalconi | 51/392 |
| 2,604,651 | 7/1952 | Crippen | 15/235 |
| 2,629,890 | 3/1953 | Di Giovanna | 15/209 |
| 3,063,083 | 11/1962 | Obitts | 15/104.92 |
| 3,490,088 | 1/1970 | Weilinski | 51/171 |
| 4,171,167 | 10/1979 | Swartwout | 15/104.92 |
| 4,283,809 | 8/1981 | Prost | 15/145 |
| 4,483,356 | 11/1984 | Kales | 132/320 |
| 4,504,994 | 3/1985 | Johnston | 15/104.92 |
| 4,559,662 | 12/1985 | Kunold, Jr. | 15/104.92 |
| 4,594,816 | 6/1986 | Goldstein | 51/393 |

*Primary Examiner*—Robert A. Rose
*Attorney, Agent, or Firm*—Leon Gilden

[57] ABSTRACT

A polishing method and apparatus is set forth utilizing an elongate stepped base assembly comprising a planar lower surface spaced below a a parallel upper surface. The upper surface includes a FIG. 8 recess therein defined by two overlapping cylindrical recesses. Each of the cylindrical recesses are of a predetermined diameter to receive a polishing rod defined by a diameter less than that of said predetermined diameter to be slidably received within each of said recesses. The polishing rod has secured thereto a first adhesive band adherably mounting a second adhesive strap onto a lowermost end surface of the polishing rod. A workpiece is adherably mounted to the second adhesive strap and directed interiorly of one of said cylindrical recesses subsequent to positioning a fabric polishing sheet containing polishing compound within the one cylindrical recess. Subsequently the polishing rod and workpiece are removed from the first of the set of cylindrical recesses and directed interiorly of a second of the interior cylindrical recesses to finish a buffing procedure of the workpiece. The first lower planar surface is oriented for reception of an enlarged polishing sheet thereon for buffing and polishing of enlarged workpiece.

6 Claims, 5 Drawing Sheets

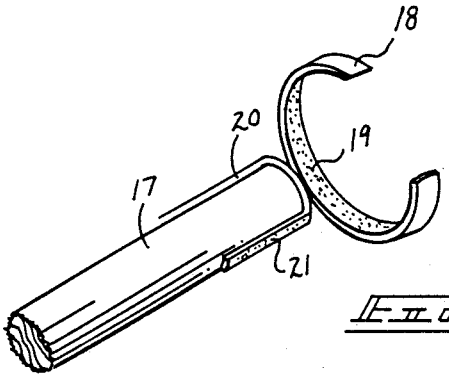
FIG 9
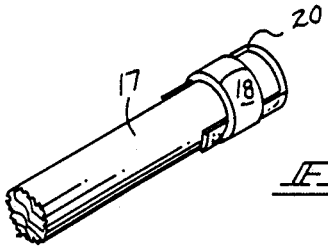
FIG 10
FIG 11
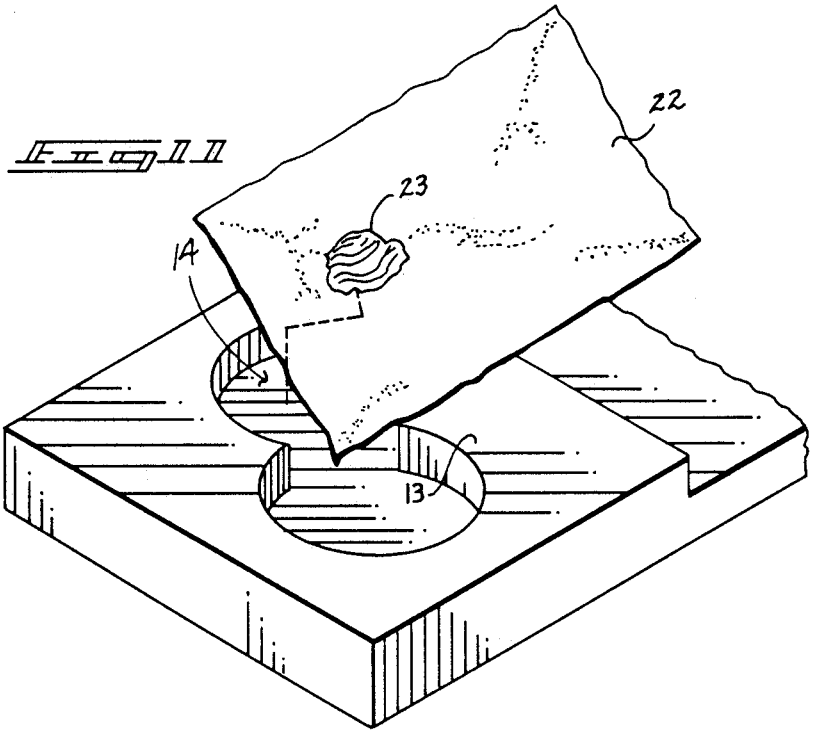

POLISHING METHOD AND APPARATUS

BACKGROUND OF THE INVENTION

1. Field of the Invention

The field of invention relates to polishing apparatus and methods, and more particularly pertains to a new and improved polishing method and apparatus wherein the same includes a base member and polishing rod cooperative to polish disk workpieces, particularly those formed of brass and the like, as may be found in military applications containing insignia inscribed and laminated thereon.

2. Description of the Prior Art

Various holders and the like for securement for securement of articles to effect a cleaning or polishing procedure has been presented in the prior art. The methods and apparatus of the prior art have been particularly directed to generic applications of structure to accommodate a wide range of workpieces to be cleansed and polished. The instant invention attempts to overcome deficiencies of the prior art by directing an apparatus and method particularly to the polishing of disks, and particularly brass disks, as may be found in military environments. Examples of the prior art include U.S. Pat. No. 2,629,890 to Giovanna illustrating a disk-like member with an upwardly directed handle and downwardly projecting clips for securement of steel wool pads to provide a holder for a cleaning procedure.

U.S Pat. No. 2,604,651 to Crippen illustrates a malleable metal strip for receiving a pad-like member at a remote end thereof and an elongate handle remotely oriented relative to the pad to enable application of paint to remote painting surfaces.

U.S. Pat. No. 4,283,809 to Prost provides a swab-holding tool wherein an elongate tubular rod receives the swab therewithin where a rearwardly positioned handle enables grasping of the swab in use.

U.S. Pat. No. 4,594,816 to Goldstein provides for a tool mounting a hinge joint for positioning of a sanding pad and the like at a lowermost end of the tool, wherein the hinge joint enables relative positioning of the handle relative to the sanding pad.

U.S. Pat. No. 4,483,356 to Kales provides for a lotion applicator wherein an adjustable length handle has receivably mounted therewithin a pad member that may be suitably mounted relative to the handle for application of lotion to a body portion.

As such, it may be appreciated that there is a continuing need for a new and improved polishing method and apparatus to enable securement of a workpiece at a remote end of a polishing rod to enable effective and easily applied polishing to the workpiece.

SUMMARY OF THE INVENTION

In view of the foregoing disadvantages inherent in the known types of polishing method and apparatus now present in the prior art, the present invention provides a polishing method and apparatus wherein the same provides for adjacent cylindrical recesses for reception of a workpiece receivable with each of said recesses to securely position the workpiece within said recesses to effect a polishing of the workpiece thereby. As such, the general purpose of the present invention, which will be described subsequently in greater detail, is to provide a new and improved polishing method and apparatus which has all the advantages of the prior art polishing methods and apparatus and none of the disadvantages.

To attain this, the polishing method and apparatus of the instant invention essentially includes an elongate rectangular stepped base portion with a lower planar surface and an upper planar surface spaced parallel and offset relative to the lower planar surface. The upper planar surface has orthogonally directed thereto a first and second cylindrical recess defining a FIG. 8 recess in an overlapped relationship with the first and second recesses, as the first recess is defined by a first axis with the second recess defined by a second axis, wherein the first and second axis are spaced together a distance less than the diameter defined by the first and second recesses each formed of an equal diameter. A polishing rod is defined by a diameter less than that of the diameters defined by the first and second recesses for slidable reception therewithin. A first strap adhesively secures a second strap, wherein the second strap extends over a lowermost end of the polishing rod and is of a width substantially equal to the diameter defined by the polishing rod. The workpiece is adherably secured to an exterior surface of the second strap and a polishing sheet is positioned overlying the first and second recesses with a polishing compound positioned over one of said recesses to effect polishing of the workpiece when the workpiece is rotated and forces directed onto the polishing compound within one of said recesses. The second recess then accommodates the polishing rod and workpiece in a buffing procedure subsequent to polishing. The lower planar surface accommodates a polishing sheet wrapped thereabout to effect polishing of enlarged workpieces.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved polishing method and apparatus which has all the advantages of the prior art polishing method and apparatus and none of the disadvantages.

It is another object of the present invention to provide a new and improved polishing method and apparatus which may be easily and efficiently manufactured and marketed.

It is a further object of the present invention to provide a new and improved polishing method and apparatus which is of a durable and reliable construction.

An even further object of the present invention is to provide a new and improved polishing method and apparatus which is susceptible of a low cost of manufacture with regard to both materials and labor, and which accordingly is then susceptible of low prices of sale to the consuming public, thereby making such polishing methods and apparatus economically available to the buying public.

Still yet another object of the present invention is to provide a new and improved polishing method and apparatus which provides in the apparatuses and methods of the prior art some of the advantages thereof, while simultaneously overcoming some of the disadvantages normally associated therewith.

Still another object of the present invention is to provide a new and improved polishing method and apparatus wherein the same enables a combination of a disk to be polished within successive recesses of a support base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 illustrates the first strap positioned for securement about the second support strap and polishing rod.

FIG. 10 is an isometric illustration of the first strap, the second strap and the polishing rod in an assembled configuration.

FIG. 11 is an isometric illustration of the polishing sheet positioned adjacent the cylindrical recesses prior to a polishing procedure.

DESCRIPTION OF THE PREFERRED EMBODIMENT

Figure 1:
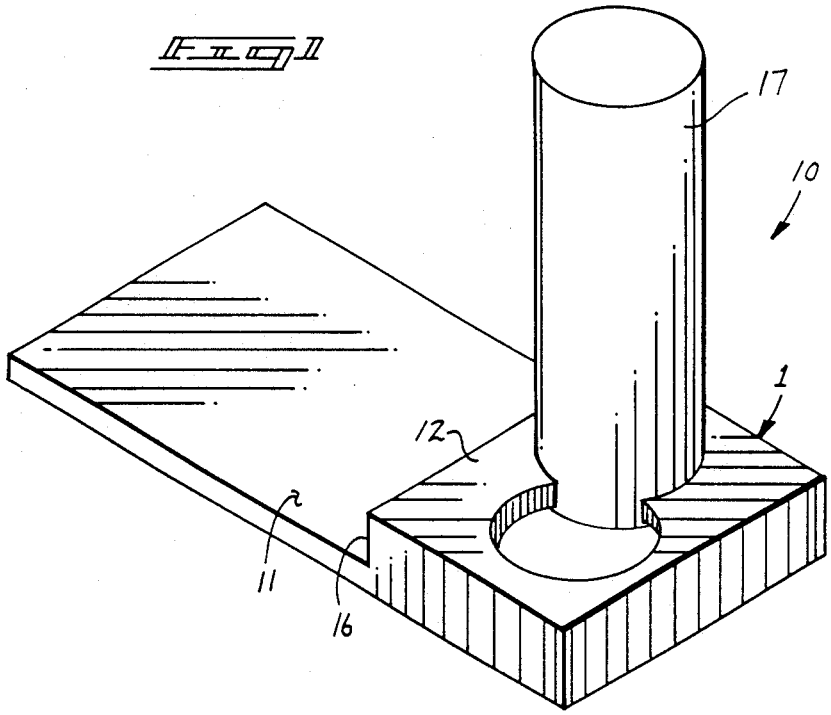
FIG. 1 is an isometric illustration of the support base and polishing rod of the instant invention.

With reference now to the drawings, and in particular to FIGS. 1 to 14 thereof, a new and improved polishing method and apparatus embodying the principles and concepts of the present invention and generally designated by the reference numeral 10 will be described.

Figure 2:
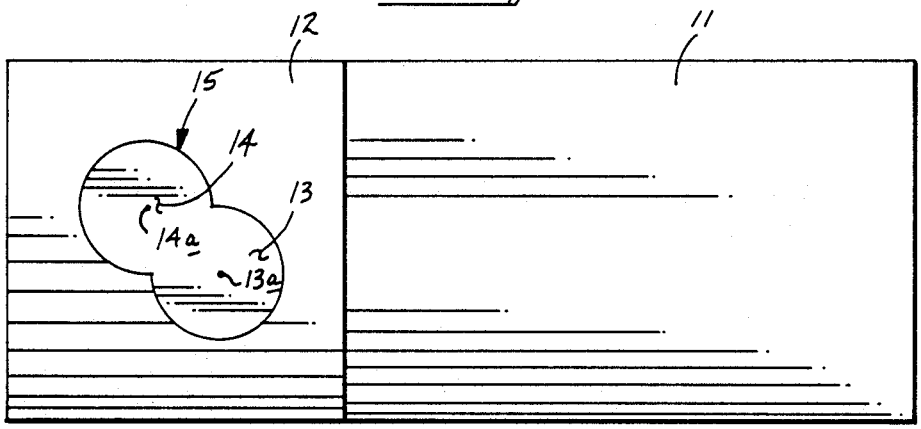
FIG. 2 is a top plan view of the support base of the instant invention.
Figure 3:
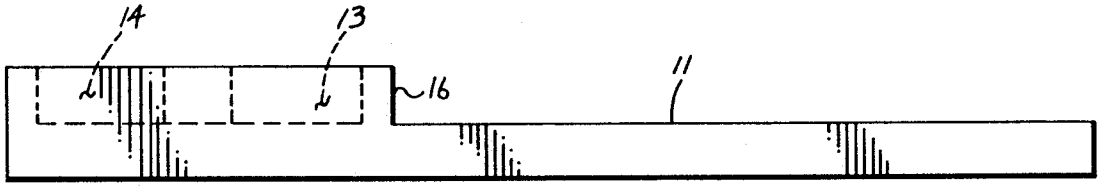
FIG. 3 is an orthographic side view taken in elevation of the support base of the instant invention.
Figure 4:
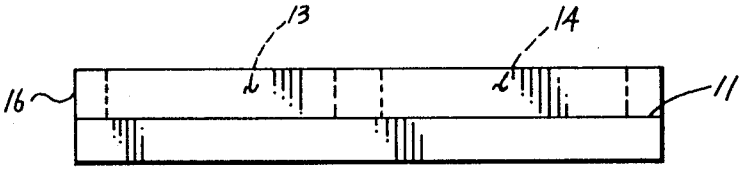
FIG. 4 is an orthographic forward end view taken in elevation of the instant invention.
Figure 5:
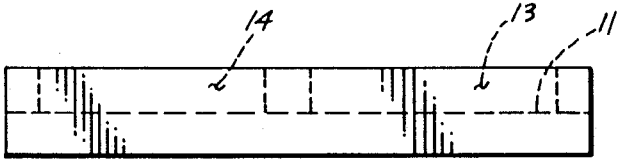
FIG. 5 is an orthographic rear end view taken in elevation of the support base of the instant invention.
Figure 6:
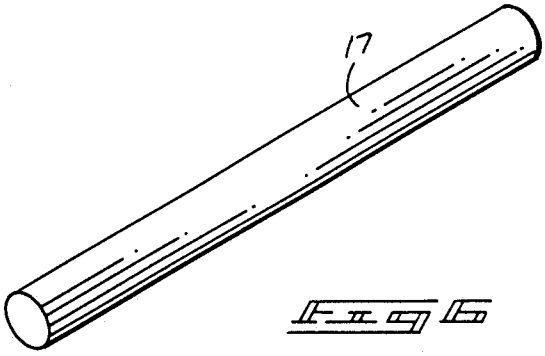
FIG. 6 is an isometric illustration of the polishing rod of the instant invention.
Figure 7:
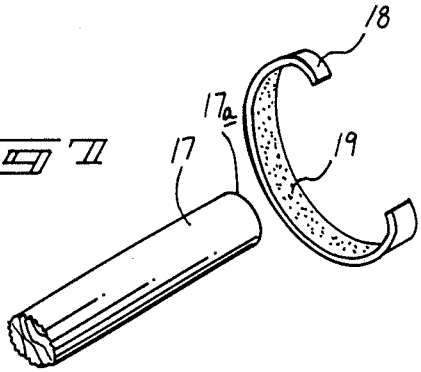
FIG. 7 is an isometric illustration of the polishing rod positioned adjacent a first support strap of the instant invention.
Figure 8:
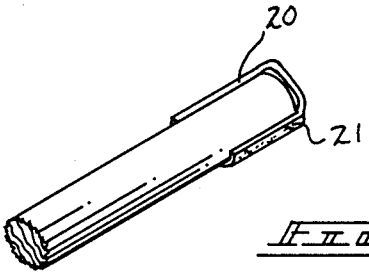
FIG. 8 is an isometric illustration of the second support strap positioned about a lowermost end of the polishing rod.
Figure 12:
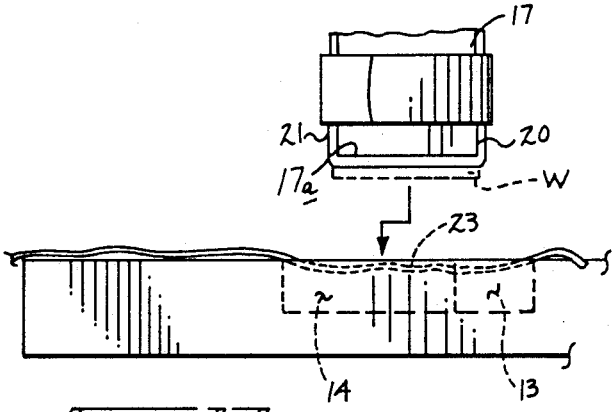
FIG. 12 is an orthographic view taken in elevation of the assembled polishing rod positioned over a cylindrical recess prior to a polishing procedure.
Figure 13:
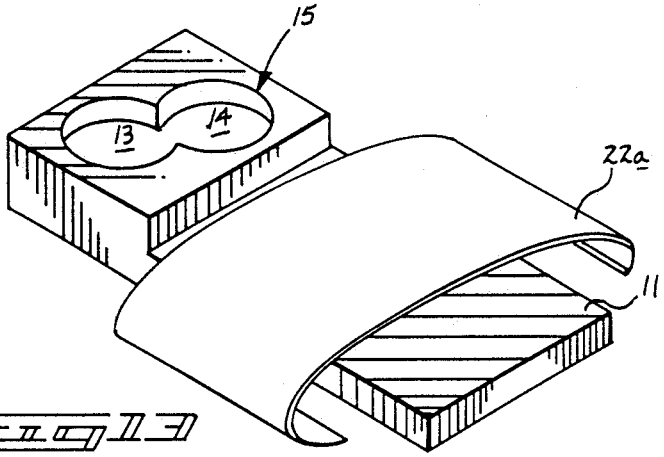
FIG. 13 is an isometric illustration of a further polishing sheet positioned about the lower surface of the support base.
Figure 14:
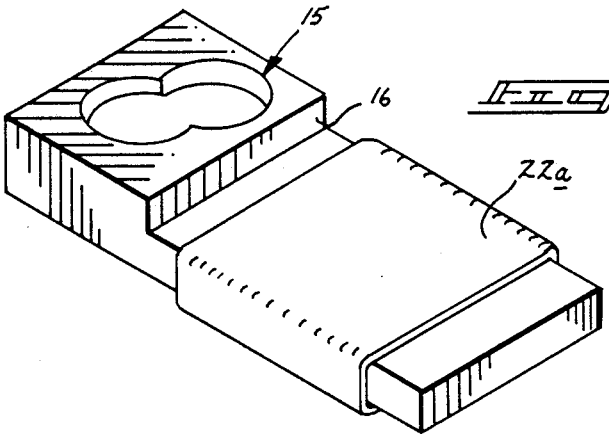
FIG. 14 is an isometric illustration of the further polishing sheet assembled about the lower support surface of the support base.

More specifically, the polishing method and apparatus 10 of the instant invention essentially comprises a stepped base assembly 1 defined by a rectangular perimeter including an elongate planar lower surface 11 with an upper planar surface 12 spaced above and offset to as well as parallel to the lower planar surface 11. The upper surface 12 includes a plurality of cylindrical recesses set forth as the first cylindrical recess 13 and a second cylindrical recess 14 of an equal predetermined diameter, wherein the recesses are in an overlapped relationship relative to one another with their respective axes 13*a* and 14*a* spaced apart a distance less than said predetermined diameter to define a FIG. 8 recess 15, as illustrated in FIG. 2. An abutment surface 16 orthogonally oriented relative to the upper and lower planar surfaces 11 and 12 respectively creates an abutment surface accommodating a polishing sheet, to be discussed in more detail, as illustrated in FIGS. 13 and 14.

The cylindrical polishing rod 17, as illustrated in FIGS. 1 and 6 through 10 and 12, is of a further diameter less than that of said predetermined diameter for receiving a first adhesive strap 18 circumferentially therearound about a lower end 17*a* of the polishing rod. The first adhesive strap 18 includes a first adhesive surface 19 for securing a second adhesive strap 20 with an associated second adhesive surface 21 oriented facing outwardly of the second adhesive strap 20 when the first adhesive strap 18 circumferentially secures the second adhesive strap 20 to the lowermost end of the polishing rod 17, as illustrated in FIG. 10 for example.

A fabric polishing sheet 22 comprised of a tightly woven non-abrading fibrous material such as cotton is of an area to overlie both the first and second cylindrical recesses 13 and 14. A polishing compound 23 is positioned medially offset relative to the upper surface of the polishing sheet 22 and positioned overlying one of the cylindrical recesses, as illustrated in FIG. 11. Subsequently, a workpiece "W", typically defined as a brass disk such as may be found in use by the military with insignia thereon, is adherably secured to the second adhesive surface 21 of the second adhesive strap 20. Thereupon, the workpiece "W" is directed interiorly of the second cylindrical recess 14 and thereby directs the polishing compound 23 and the underlying fabric polishing sheet 22 within the second cylindrical recess 14 whereupon rotation and contra-rotation of the polishing rod 17 within the second adhesive recess 14 effects a polishing of the surface of the workpiece "W". Subsequently, the polishing rod 17 is withdrawn and directed over the remaining cylindrical recess, such as the first cylindrical recess 13 to effect a buffing of the workpiece "W" that has been polished in the first step, as noted above.

When enlarged workpieces are to be utilized, the enlarged workpiece may be again adherably secured to the surface 21 of the second adhesive strap 20 overlying the lowermost end 17*a* of the polishing rod, whereupon a further polishing sheet 22 is wrapped around the lower planar surface 11 to enable polishing of disks and medallions of a dimension not accommodated by the first and second cylindrical recesses 13 and 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A polishing apparatus kit comprising in combination, a base assembly including at least one surface, said one surface including a first and second recess therein, and an elongate polishing rod selectively receivable within one of said first and second recesses, and a lower planar surface spaced below said at least one surface and offset relative thereto on said base assembly, and a fibrous polishing sheet, said polishing sheet including a polishing compound portion positioned thereon, and said polishing compound portion selectively positionable over one of said first and second recesses or selectively upon said lower planar surface, and a strap means for securing a workpiece to said polishing rod to enable polishing of said workpiece upon rotation of said polishing rod within one recess of said first and second recesses when said workpiece is captured between said polishing rod and said polishing sheet, and to permit a buffing of said workpiece in a second recess of said first and second recesses.

2. A polishing apparatus kit as set forth in claim 1 wherein said strap means includes a first strap with an outer first adhesive surface, and a second strap with a second adhesive outer surface, and said second strap positionable over a lowermost end of said polishing rod and said second strap circumferentially positionable in securing engagement of said second strap and said polishing rod.

3. A polishing apparatus kit as set forth in claim 2 wherein said first strap includes said first adhesive surface in engagement with an exterior surface of said polishing rod, and said second strap including said second adhesive surface oriented exteriorly of a lowermost end of said polishing rod, and said workpiece adherably secured to said second adhesive surface aligned with the lowermost end of said polishing rod.

4. A polishing apparatus kit as set forth in claim 3 wherein said polishing sheet is cotton.

5. A polishing apparatus kit as set forth in claim 4 wherein said first and second recesses are each of an equal predetermined diameter, and wherein said first and second recesses are aligned axially parallel to one another including a first axis defined by said first recesses and a second axis defined by said second recess, and wherein said first and second axis are spaced apart a distance less than said predetermined diameter to secure the polishing sheet between the first and second recesses.

6. A polishing apparatus kit as set forth in claim 5 wherein the polishing rod defines a further diameter less than that defined by said predetermined diameter.

* * * * *